United States Patent [19]

Lundkvist et al.

[11] 4,065,652

[45] Dec. 27, 1977

[54] CONTACT ASSEMBLY AND MOUNTING STRUCTURE FOR CROSS BAR SELECTOR SWITCH

[75] Inventors: Bror Ludvig Lundkvist, Skarholmen; Sven-Erik Lindeberg, Huddinge; Karl Sievert Forsberg, Lyckeby, all of Sweden

[73] Assignee: Telefonaktiebolaget L M Ericsson, Stockholm, Sweden

[21] Appl. No.: 611,680

[22] Filed: Sept. 9, 1975

[30] Foreign Application Priority Data

Sept. 27, 1974 Sweden ..... 7412184

[51] Int. Cl.[2] ..... H01H 1/24; H01H 63/06

[52] U.S. Cl. ..... 200/175; 200/246; 200/247; 200/275

[58] Field of Search ..... 200/175–179, 200/275–278, 86 R, 159 B, 245–247

[56] References Cited

U.S. PATENT DOCUMENTS

| | | | |
|---|---|---|---|
| 2,896,042 | 7/1959 | Koenig | 200/86 R |
| 3,056,005 | 9/1962 | Larson | 200/86 R |
| 3,166,645 | 1/1965 | Shlesinger, Jr. | 200/175 UX |
| 3,275,781 | 9/1966 | Highley et al. | 200/275 X |
| 3,602,677 | 8/1971 | Adelson et al. | 200/275 |
| 3,617,666 | 11/1971 | Brave | 200/86 |
| 3,713,054 | 1/1973 | Elliott | 200/175 X |
| 3,786,205 | 1/1974 | Lieu | 200/275 X |

*Primary Examiner*—James R. Scott

*Attorney, Agent, or Firm*—Hane, Roberts, Spiecens & Cohen

[57] ABSTRACT

Arrangement in a selector, especially in a crossbar selector, comprising a number of contact spring sets arranged parallel to each other in a contact frame, wherein the contact spring sets, when operated, make contact with a contact multiple common to the sets. The contact springs are provided with elongated transverse contact surfaces and the contact multiple is made up of rod-shaped contact elements which are transversally attached to conductors. The conductors run across the contact frame parallel to the contact surfaces of the contact springs.

4 Claims, 7 Drawing Figures

CONTACT ASSEMBLY AND MOUNTING STRUCTURE FOR CROSS BAR SELECTOR SWITCH

BACKGROUND OF THE INVENTION

The present invention relates to an arrangement in a selector, especially in a crossbar selector, comprising a number of contact spring sets arranged parallel to each other in a contact frame, wherein the contact springs, when operated, make contact with a contact multiple common to the sets.

In commonly used types of selectors, especially crossbar selectors, the contact springs are of the leaf spring type and provided with welded or riveted contacts of a suitable contact material, usually silver. The contacts have an essentially spherical contact surface and co-operate with a contact multiple which is often constituted of continuous strips of contact material fitted in a contact frame common to a number of contact groups arranged side by side. The fitting of the contacts on the springs, which are made of a band material, takes place after the contact springs have passed a punching operation whereby they may have been provided with guide holes intended for the attachment of the contacts. The contacts are cut from wire material and formed to their final shape in connection with the fitting. Then the final punching of the springs from the material is done. This process involves high costs partly on account of the many manufacturing steps and partly on account of the fact that it results in a high rejection rate.

SUMMARY OF THE INVENTION

The purpose of the invention is to provide a fast and exact automized production of contact springs with contacts of contact material, to be used in a selector with a contact multiple. This is attained, according to the invention, by shaping the contact surfaces as elongated surfaces extending across the contact springs. In this way it is possible to provide the contact spring material with these surfaces, for instance by welding on a silver thread, in an automized process before forming the contact springs. It is convenient to do this forming by automized punching of the springs from a band-shaped material, the width of which is equal to the length of the completed springs. A problem arising now is to design the contact multiple in a suitable way in order to achieve a good and reliable contact function at the same time as it shall be economic to manufacture. According to the invention the problem is solved in such a way that the contact multiple has been provided with rod-shaped contact elements being transversely arranged in relation to the contact surfaces and being interconnected by means of conductors extending parallel.

BRIEF DESCRIPTION OF THE DRAWING

The invention will be described below by means of an embodiment with reference to the appended drawing on which, in FIG. 1, a cut out portion of a contact frame with associated contact multiple and contact springs are shown in perspective. FIGS. 2, 3 and 4 show some alternative designs of the contact multiple while

DETAILED DESCRIPTION OF THE INVENTION

Figure 1:
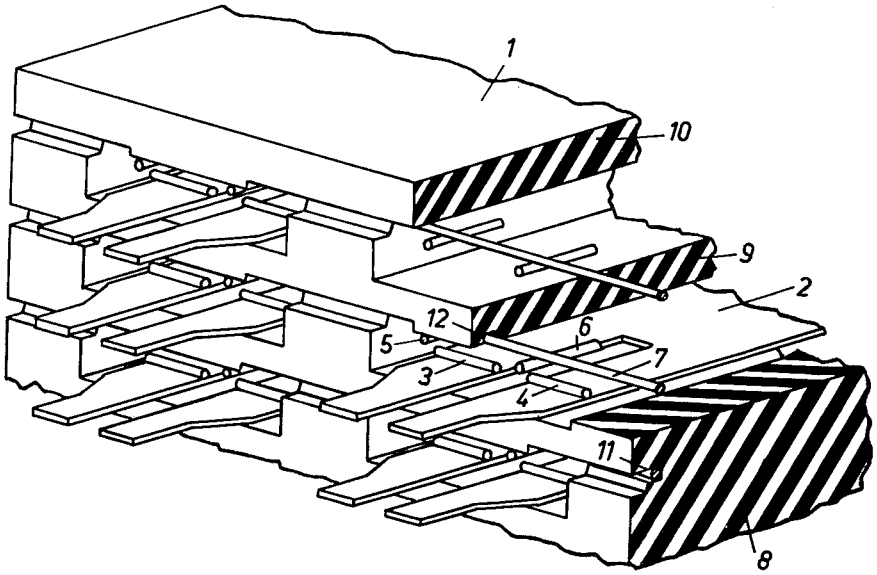
Figure 2:
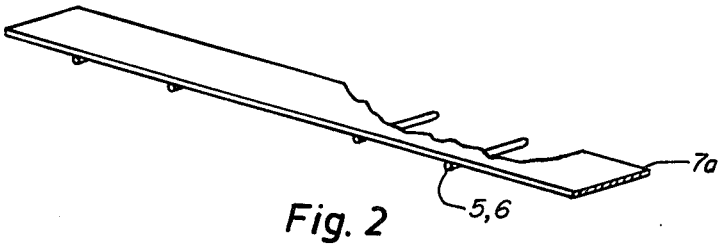
Figure 3:
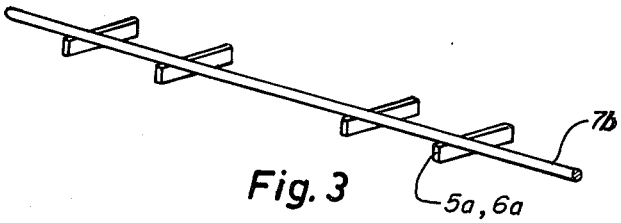
Figure 4:
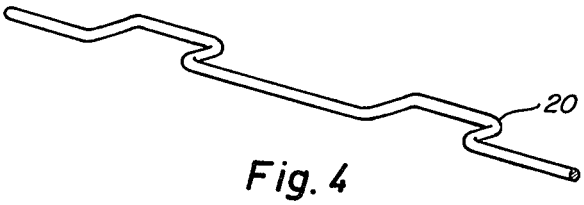

The contact frame designated with 1, shown in FIG. 1, has been cut to show more clearly the design of the contact multiple and the contact springs. The three hatched surfaces of the sections are also shown in side elevation and enlarged in FIGS. 5–7 in order to show an example of how the contact multiple can be fitted in the contact frame. The contact springs 2 are of the twin contact type and consequently each has two contact surfaces 3, 4 which according to the embodiment are straight, while in profile convex elevations extend across the tongues of the contact springs. For coacting with these contact surfaces the contact multiple is provided with rod-shaped contact elements, 5, 6, which according to the embodiment in FIG. 1 are made from wire and supported by conductors 7, likewise made of wire. The conductors 7 extend through the contact-frame in parallel with the above-mentioned contact surfces 3 and 4. In manufacture, a right-angled wire netting is first made by welding together the two wire materials and then the netting is cut parallelly to the conductor wires. Alternatively the conductor 7*a* may be band-shaped. If the conductor, as shown in FIG. 2, has a width that is identical with the length of the rod-shaped contact elements 5, 6 (in the figure a cut has been made to make this clear) a more economic production is made possible. At first wires are welded in parallel with each other onto a sheet and then the band-shaped conductors with their rod-shaped contact elements are made by cutting in a direction crosswise of the wires. In FIG. 3 the converse arrangement is shown, with band-shaped contact elements 5*a* and 6*a* on wire-shaped conductors 7*b*, and in FIG. 4 another embodiment is shown, where contact elements have been formed by zig-zag-bending of a wire-shaped conductor 20. The three designs according to FIGS. 2–4 are economically feasible due to the fact that only the rod-shaped elements have to be made of contact material. At the same time they permit the conductor material to be chosen according to the way of fitting the contact multiple in the contact-frame. Thus, the conductors man be made of a resilient material and be kept in place by clamping between a number of notched sections 11, 12 interleaving each other in the contact frame as is shown in the embodiment according to FIG. 1.

Figure 5:
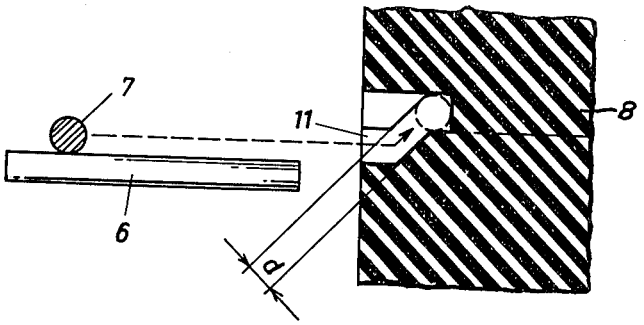
FIGS. 5, 6 and 7 show details of the contact frame design.
Figure 6:
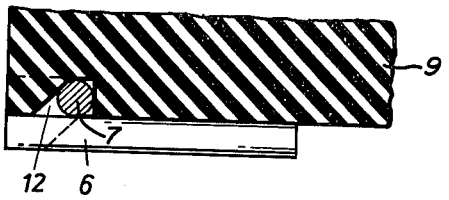
Figure 7:
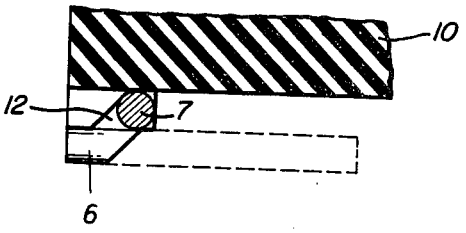

FIG. 5 is a detail picture of the cut contact frame section 8 in FIG. 1 partly showing a cut through a notch section 11 and partly a notch section 12 (note FIG. 6) behind that. The notch section 12 is open in the direction towards the contact spring while the section 11 is open in transverse direction. The opening formed by projecting section 11 on section 12 has a width which is less than the diameter of the wire conductor 7, and hence the latter has to be bent in order to pass the opening. FIG. 6 shows the cut contact frame section 9 according to FIG. 1, across a notch section 12, and this figure clearly shows how the conductor and the contact elements are kept in place. FIG. 7 finally shows the cut contact frame section 10 in FIG. 1. From this figure it is evident that here the conductor is able to exercise the necessary bending during assembly as the movements of the conductor are not limited in any direction while passing to the final position as illustrated.

We claim:

1. In a selector switch comprising a plurality of contact springs having transverse contact surfaces thereon, and a contact frame mounting said plurality of contact springs therein, wherein the improvement comprises: a plurality of contact strips, each of said plurality of contact strips comprising a conductor mounted in said contact frame near said contact surfaces of at least some of said plurality of contact springs and extending parallel with said contact surfaces, and a plurality of rod-shaped contact elements mounted on said conductor in a direction transversely of said contact surfaces of said some of said plurality of contact springs; and said contact frame comprises means for mounting said plurality of contact strips therein, said means comprising a plurality of first notched sections, each of said plurality of first notched sections having a groove which is open in a direction towards said contact surfaces mounted directly therebelow, and a plurality of second notched sections, each of said plurality of second notched sections having a groove which is open transversely to the direction of the grooves of said first notch sections, whereby said conductors of said contact strips are contained in said grooves of said first and second notched sections which accommodates said conductors after said conductors have been directed thereto.

2. The improvement according to claim 1, wherein one of said plurality of first notched sections is followed by one of said plurality of second notched sections, and said one second notched sections is followed by another one of said first notched sections, such that a repeating pattern of alternating first and second notched section results with a contact spring mounted between adjacent notched sections.

3. The improvement according to claim 1, wherein each of said conductors is band-shaped, and each of said plurality of rod-shaped contact elements extends the whole width of said band-shaped conductor such that the width of said conductor and the length of each of said plurality of rod-shaped contact elements are equal.

4. The improvement according to claim 2, wherein each groove of said first notched section has a wider opening than that of each groove of said second notched section.

* * * * *